US007632141B2

(12) United States Patent
Malak

(10) Patent No.: US 7,632,141 B2
(45) Date of Patent: Dec. 15, 2009

(54) COMPACT COMPRESSION CONNECTOR WITH ATTACHED MOISTURE SEAL

(75) Inventor: Stephen Malak, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/709,430

(22) Filed: Feb. 22, 2007

(65) Prior Publication Data

US 2008/0207033 A1 Aug. 28, 2008

(51) Int. Cl.
*H01R 9/05* (2006.01)

(52) U.S. Cl. ..... 439/578; 439/271

(58) Field of Classification Search ..... 439/578, 439/583, 584, 271
See application file for complete search history.

(56) References Cited

U.S. PATENT DOCUMENTS

| | | | | |
|---|---|---|---|---|
| 2,703,359 | A * | 3/1955 | Miller | 362/396 |
| 3,387,252 | A * | 6/1968 | Rothweiler | 439/148 |
| 3,520,342 | A | 7/1970 | Scheffer | |
| 3,710,005 | A | 1/1973 | French | |
| 3,910,673 | A | 10/1975 | Stokes | |
| 4,046,451 | A | 9/1977 | Juds et al. | |
| 4,156,554 | A | 5/1979 | Aujla et al. | |
| 4,367,060 | A | 1/1983 | Berecz | |
| 4,659,272 | A | 4/1987 | Pratt | |
| 4,824,400 | A | 4/1989 | Spinner | |
| 4,834,675 | A * | 5/1989 | Samchisen | 439/578 |
| 4,902,246 | A * | 2/1990 | Samchisen | 439/578 |
| 4,907,924 | A | 3/1990 | Hellon | |
| 4,960,342 | A | 10/1990 | Chi | |
| 5,083,943 | A | 1/1992 | Tarrant | |
| 5,186,655 | A | 2/1993 | Glenday et al. | |
| 5,283,853 | A | 2/1994 | Szegda | |
| 5,284,449 | A | 2/1994 | Vaccaro | |
| 5,322,454 | A | 6/1994 | Thommen | |
| 5,342,218 | A | 8/1994 | McMills et al. | |
| 5,362,250 | A | 11/1994 | McMills et al. | |
| 5,435,745 | A | 7/1995 | Booth | |
| 5,454,675 | A | 10/1995 | DeHaitre | |
| 5,464,675 | A | 11/1995 | Weir | |
| 5,499,934 | A | 3/1996 | Jacobsen et al. | |
| 5,561,900 | A | 10/1996 | Hosler, Sr. | |
| 5,571,028 | A | 11/1996 | Szegda | |
| 5,651,698 | A | 7/1997 | Locati et al. | |
| 5,667,405 | A | 9/1997 | Holliday | |
| 5,766,037 | A | 6/1998 | Nelson | |
| 5,769,662 | A * | 6/1998 | Stabile et al. | 439/578 |
| 5,795,188 | A | 8/1998 | Harwath | |
| 5,800,211 | A | 9/1998 | Stabile et al. | |

(Continued)

OTHER PUBLICATIONS

U.S. Appl. No. 11/322,097, filed Dec. 29, 2005, Montena.

*Primary Examiner*—Edwin A. Leon
*Assistant Examiner*—Vanessa Girardi
(74) *Attorney, Agent, or Firm*—Marjama Muldoon Blasiak & Sullivan LLP

(57) ABSTRACT

A compression connector for the end of a coaxial cable is provided, wherein a moisture seal element is attached to an attachment element, and wherein the attachment element is attached to, adjoined to, or otherwise placed in tactile communication with the compression connector, thus in effect placing the moisture seal in communication with the connector so as to prevent the moisture seal element from being inadvertently lost or misplaced prior to installation of the connector.

10 Claims, 3 Drawing Sheets

U.S. PATENT DOCUMENTS 5,857,865 A 1/1999 Shimirak et al.
5,877,452 A 3/1999 McConnell
5,904,587 A 5/1999 Osypka et al.
5,938,474 A 8/1999 Nelson
5,975,951 A 11/1999 Burris et al.
5,980,315 A 11/1999 Matsuda et al.
5,984,723 A 11/1999 Wild
5,993,254 A 11/1999 Pitschi et al.
6,019,636 A 2/2000 Langham
6,032,358 A 3/2000 Wild
6,053,749 A 4/2000 Masuda et al.
6,065,981 A * 5/2000 Sopotnick et al. ..... 439/135
6,089,912 A * 7/2000 Tallis et al. ..... 439/584
6,102,737 A 8/2000 Gohdes
6,210,222 B1 4/2001 Langham et al.
6,261,125 B1 7/2001 Yeh et al.
6,287,136 B1 * 9/2001 Deutsch ..... 439/337
6,471,545 B1 10/2002 Hosler, Sr.
6,558,194 B2 5/2003 Montena
6,592,403 B2 7/2003 Kooiman
6,676,446 B2 1/2004 Montena
6,692,300 B2 2/2004 Kanda et al.
6,884,113 B1 4/2005 Montena
D513,406 S * 1/2006 Rodrigues et al. ..... D13/133
7,097,500 B2 8/2006 Montena
7,114,990 B2 10/2006 Bence et al.
7,226,300 B2 * 6/2007 Khemakhem ..... 439/135
2003/0207601 A1 * 11/2003 Adachi ..... 439/135
2003/0211778 A1 11/2003 Burris et al.
2004/0082218 A1 4/2004 Stirling
2005/0029807 A1 2/2005 Montena
2005/0176294 A1 8/2005 Montena
2008/0139028 A1 * 6/2008 Burris et al. ..... 439/271

* cited by examiner 100
72
76
90
56
62
82
54
34
67
20
66
60
52
209
205
208
200
207
74
280
24
204
206
10
26
22
70
40
58
210
300
30
32
28
80B
80A
84
69
64
68

COMPACT COMPRESSION CONNECTOR WITH ATTACHED MOISTURE SEAL

FIELD OF THE INVENTION

This invention relates in general to coaxial cable connectors, and, more particularly, to compression connectors for use with coaxial cables wherein at least one part (e.g., a moisture seal) of the connector is attached to, adjoined to, or otherwise in communication with the connector prior to installation of the connector.

BACKGROUND OF THE INVENTION

The deployment of 50 ohm coaxial cable, such as 200, 400 and 500 sizes of cable, for video and data transfer is ever increasing. Present 50 ohm connectors require labor intensive and craft sensitive installation. In one proposed approach, a 50 ohm connector is supplied as a kit and is installed onto a coaxial cable in stages, which must occur in a set order and may require soldering for proper assembly. Another proposed installation approach employs multiple threaded body sections and requires the use of multiple wrenches to draw the separate body sections together, thereby exerting a clamping force onto the cable.

The connectors used in both of these approaches are relatively expensive, most notably due to their multitude of precision parts. Furthermore, both of these installation techniques are prone to errors that may not be readily apparent to or perceived by the installer, e.g., the threaded body sections not having been fully tightened together.

A more fundamental problem, however, involves one or more of the precision parts of the connector becoming inadvertently lost or misplaced prior to or during the installation process. When this occurs, it results in economic loss due to absorbing the cost of the lost or misplaced part(s), plus it causes non-nominal installation delays in order to identify the particular problem and to locate and install the suitable replacement part(s). And although such installation delays can be experienced in factory and field installation settings, the resulting delays are often more impacting in a field setting since there it is less likely that a spare part will be immediately on hand.

This problem can plague nearly all cable connectors that are being currently sold and used, even those that otherwise function well. U.S. Pat. No. 4,869,679 to Szegda (hereinafter referred to as "the '679 patent" and hereby incorporated by reference in its entirety) describes a cable connector assembly, which, as installed in its commercial form, is highly reliable and effective, particularly with regard to moisture resistance. However, some of the precision parts of the commercial form of the connector assembly described in the '679 patent are packaged separately from one another. For example, prior to installation, the sealing element of the commercial form of the connector assembly is generally packaged apart from the other precision parts such as the connector body. Thus there have been reported instances in which the sealing element is lost or misplaced prior to or during installation. And given the importance of the sealing element in providing moisture resistance, this leaves the installation technician no choice but to replace the lost/misplaced sealing element, which is not ideal, or to not install the connector assembly, which is not acceptable.

It also has been acknowledged that so-called "radial compression type" end connectors (e.g., those described in the '679 patent, U.S. Pat. No. 3,498,647 to Schroder, U.S. Pat. No. 3,985,418 to Spinner, U.S. Pat. No. 4,059,330 to Shirey, U.S. Pat. No. 4,444,453 to Kilry et al., and U.S. Pat. No. 5,024,606 to Yeh Ming-Hwa, each of which is hereby incorporated by reference in its entirety) are especially prone to suffer from this lost or misplaced connector parts problem.

One attempt to solve this problem is embodied in U.S. Pat. No. 4,902,246 to Samchisen (hereinafter referred to as "the '246 patent" and hereby incorporated by reference in its entirety), which depicts and describes a "snap-and-seal" coaxial connector. Prior to installation, and in accordance with the '246 patent, a compression sleeve is attached, via an attachment ring, to a portion of a collar member of the connector. That, in turn, prevents the compression sleeve from being inadvertently lost or misplaced prior to installation of the connector. During the actual connector installation process, the compression sleeve is slid over the coaxial cable and the connector body is inserted into the attachment ring, which is then detached from the compression sleeve.

Unfortunately, the solution offered by the '246 patent has its own set of shortcomings. In particular, the process of manufacturing the connector to include the integral attachment ring and attached compression sleeve is quite complex and does not allow for much, if any, freedom with regard to how the attachment ring is attached to the connector, let alone the attachment location.

Consequently, there is a need for methods and devices that eliminate the problem of lost or misplaced precision parts of a connector by attaching one or more of such parts to the connector prior to installation a connector, wherein such methods and devices are not unduly complex, yet also enable such parts to be attached at a wide variety of locations.

SUMMARY OF THE INVENTION

These and other needs are met in accordance with the below-described embodiments, which are directed to various methods and devices for preventing one or more precision parts or components of a compression connector from being inadvertently lost or misplaced prior to installation of the connector.

In accordance with an exemplary embodiment, a compression connector for the end of a coaxial cable comprises a connector body that has a first end, a second end, and an outer diameter. An attachment element has an opening defined therein, wherein the opening has a first, unincreased diameter less than at least a portion of the outer diameter of the connector body, and a second, increased diameter greater than at least a portion of the outer diameter of the connector body. The opening of the attachment element is placed around the connector body at a predetermined placement location while the second, increased diameter of the opening of the attachment element is substantially maintained. If desired, the predetermined placement location can have a diameter less than that of the first, unincreased diameter of the opening of the attachment element, such that once the attachment element is placed at that placement location the diameter of the attachment element will automatically revert to its first, unincreased diameter so as to prevent inadvertent detachment of the attachment element. That, in turn, prevents the loss of misplacement of a connector component (e.g., a moisture seal) that is also attached to the attachment element (e.g., at a connection zone or area).

The connector body can comprise one or more elements including but not limited to: a main body portion that has a first end and a second end, and a post disposed at least partially within the main body portion. The connector also can comprise: a locking member (e.g., a compression ring) that includes a first end and a second end, wherein the second end is disposed within the main body portion, and a fastening element (e.g., a nut) that includes a first end and a second end, wherein the fastening element can contain the second end of the main body portion. In such an embodiment, the predetermined placement location of the attachment element can be, e.g., between the fastening element and the main body portion.

An exemplary method for preventing the inadvertent loss or misplacement of a component of a compression connector for the end of a coaxial cable can comprise the steps of (a) providing a compression connector that has a connector body, wherein the connector body includes a first end, a second end, and an outer diameter, (b) providing a connector component attached to an attachment element, wherein the attachment element has an opening, and wherein the opening has a first, unincreased diameter less than at least a portion of the outer diameter of the connector body, (c) increasing the unincreased diameter of the opening of the attachment element to become a second, increased diameter, wherein the second, increased diameter is greater than at least a portion of the outer diameter of the connector body; and (d) while the second, increased diameter of the attachment element is substantially maintained, placing the opening of the attachment element around a predetermined placement location of the connector body.

Still other aspects, embodiments and advantages are discussed in detail below. Moreover, it is to be understood that both the foregoing general description and the following detailed description are merely illustrative examples, and are intended to provide an overview or framework for understanding the nature and character of the embodiments claimed and described. The accompanying drawings are included to provide a further understanding of the various embodiments claimed and described, are incorporated in and constitute a part of this specification, and, together with the description, serve to explain the principles and operations of the various embodiments claimed and described.

BRIEF DESCRIPTION OF THE DRAWINGS

For a fuller understanding of the nature and desired objects of the embodiments claimed and described herein, reference is made to the following detailed description taken in conjunction with the accompanying figures, wherein like reference characters denote corresponding parts throughout the views, and in which:

DETAILED DESCRIPTION OF THE INVENTION

Figures 1, 2, 3:
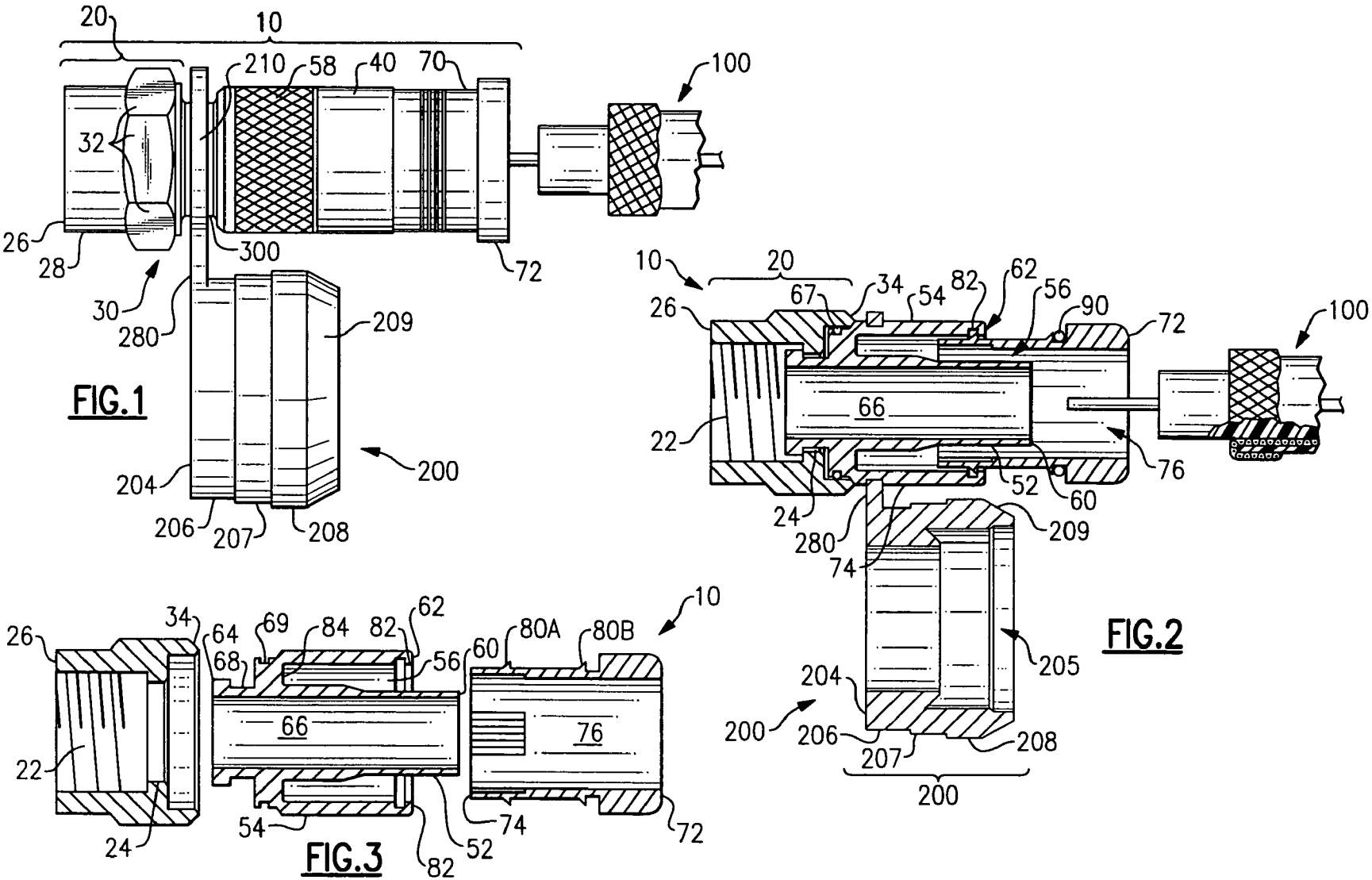
FIG. 1 is a front view of an exemplary arrangement for attaching a seal element to an exemplary internal compression connector prior to installation of the connector.
FIG. 2 is a front, partial cutaway view of the connector of FIG. 1.
FIG. 3 is an front, exploded view, with partial cutaway of the connector of FIG. 1.

Referring initially to FIGS. 1-3, an end connector 10 for coaxial cable is shown. The connector 10 is comprised of a fastening element 20, a body portion 40, and a locking member 70, each as described below. The depicted connector 10 is a so-called internal radial compression type coaxial cable F-connector. An exemplary such connector also is shown and described in U.S. Pat. No. 5,470,257 to Szegda, which is hereby incorporated by reference in its entirely. It is understood that the concepts and features of the connector 10 depicted in FIGS. 1-3 (and in FIG. 8B) and described herein are applicable to other types of coaxial cable connectors as well, including, but not limited to, external radial compression type connectors (see connector 10*a* in FIGS. 4, 5 and 8A), crimped-style cable connectors (see connector 10*b* in FIG. 9) and threaded-style cable connectors, as well as still other types of compression connectors.

FIGS. 1 and 2 also depict a segment of cable 100 to which the connector 10 is ultimately connected using equipment and techniques known to one of ordinary skill in the art. The cable segment 100 can be, by way of non-limiting example, spiral corrugated coaxial cable (e.g., of the type depicted and described in U.S. Pat. No. 6,558,194 to Montena, which is incorporated by reference in its entirety herein) and can be connected to the connector via, as one example, a compression process. It is understood, however, that the connector 10 can be connected to other types of cable, if instead desired, by employing equipment and techniques known to one of ordinary skill in the art.

As shown in FIGS. 1-3, the fastening element 20 of the connection 10 can be in the form of a nut and can include internal threads 22 and an internal shoulder 24. The internal threads 22 can span the entire nut 20, or, as shown in FIGS. 2 and 3, can span solely the portion between an end 26 of the nut and the internal shoulder 24. As best illustrated in FIG. 1, the outer periphery of the nut 20 of the connector 10 includes a smooth portion 28, as well as a portion 30 that has raised hex flats 32. The other end 34 of the nut 20 is sized and shaped to accommodate at least a portion of the body portion 40 of the connector 10, as will be discussed below.

The body portion 40 of the connector 10 includes a post 52, which is surrounded by an outer collar 54 so as to define an annular chamber 56 between the post and the outer collar. Although the post 52 and the outer collar 54 are generally manufactured as a single piece, they can be formed, alternatively, as separate pieces that are connected (e.g., via press fit) together. Generally, the post 52 and the outer collar 54 are formed of a metal material (e.g., brass); however, in the alternative, either or both such components can be formed of a plastic material (e.g., an elastomeric material such as Delrin® plastic).

At least a portion (and, optionally, the entirety of) the outer periphery of the body potion 40 of the connector 10 can include surface texturing. For example, and as depicted in FIG. 1, a portion 58 of the outer periphery of the body portion 40 can be knurled. A portion of the nut 20 can include surface texturing as well, if desired. In each instance, the presence of the surface texturing enables one to better achieve and maintain a grip upon the textured elements, e.g., during a "by-hand" installation of the connector 10, such as may occur indoors.

As best shown in FIGS. 2 and 3, the post 52 has a first end 60 that extends beyond the end 62 of outer collar 54, and a second end 64 that represents a furthermost portion of the outer collar. The post 52 has an inner bore 66, which can have a varied diameter, or, as illustrated by FIGS. 2 and 3, which can have a substantially constant diameter.

Also in accordance with the FIGS. 1-3 exemplary embodiment, and as best shown in FIG. 3, the post 52 can include first and second grooves 68, 79, wherein the first groove 68 is sited and shaped so as to enable the inner shoulder 24 of the fastening element 20 to be reversibly seated therewithin, and wherein an optional sealing element 67, such as an O-ring (see FIG. 2), can be disposed within the second groove 69 so as to provide added moisture resistance to the installed connector 10. The connection between the fastening element 20 and the body portion 40 should be secure, but also should allow the fastening element to be freely rotatable while being held in place as part of the connector 10.

In further accordance with the exemplary embodiment of FIGS. 1-3, the locking element 70 can be in the form of a compression ring. The locking element 70 has an open first end 72, an open second end 74 and a continuous bore 76 therebetween.

The diameter of the continuous bore 76 can be varied, or, as shown in FIGS. 1-3, can be substantially constant. In the illustrated exemplary embodiment, the diameter of the bore 76 of the locking element 70 is greater than the outer diameter of the post 52, yet also small enough such that the ring can fit within the annular chamber 56 defined between the post 52 and the outer collar 54 of the body portion 40.

In yet further accordance with the FIGS. 1-3 exemplary embodiment, the outer periphery of the locking element 70 can include a plurality of surface features 80 to facilitate or enable engagement of the locking element 70 with the annular chamber 56 of the body portion 40. By way of non-limiting example, and as best shown in FIG. 3, there can be a plurality of surface features 80A, 80B, wherein surface feature(s) 80A can be, e.g., one or more protrusions sized and shaped to fit within and become reversibly engaged with an internal groove 82 of the annular chamber 56, and wherein surface feature(s) 80B can be, e.g., one or more protrusions against which an optional sealing element 90 (e.g., an O-ring as depicted in FIG. 2) can be positioned in order to provide the connector 10 with added moisture resistance.

After the second end 74 of the locking element 70 is introduced within the annular chamber 56 of the body portion 40, and as the locking element is advanced within the annular chamber, the one or more protrusions 80A will become seated within the groove 82 as shown in FIG. 2. This signifies an assembled, but "open" condition for the connector 10 wherein the second end 74 of the locking element 70 is not in tactile communication with an end 84 of the annular chamber 56. Upon still further advancement of the locking element 70 within the annular chamber 56, the protrusion 80A becomes unseated from the groove 82, and the protrusion 80B will become seated within groove 82. This signifies an assembled and "closed" position for the connector 10 wherein the second end 74 of the locking element 70 is in tactile communication with the end 84 of the annular chamber 56. In this "closed" position, the sealing element 90, if present, is maintained in place between the body portion 40 and a shoulder 86 of the locking element 70.

Figure 4:
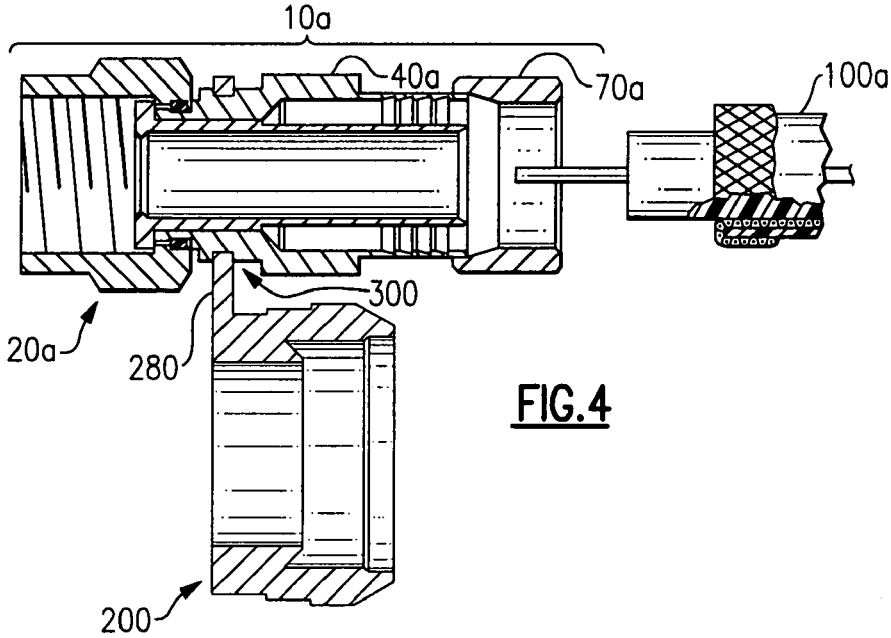
FIG. 4 is a front, partial cutaway view of an exemplary arrangement for attaching a seal element to an exemplary external compression connector prior to installation of the connector.
Figure 5:
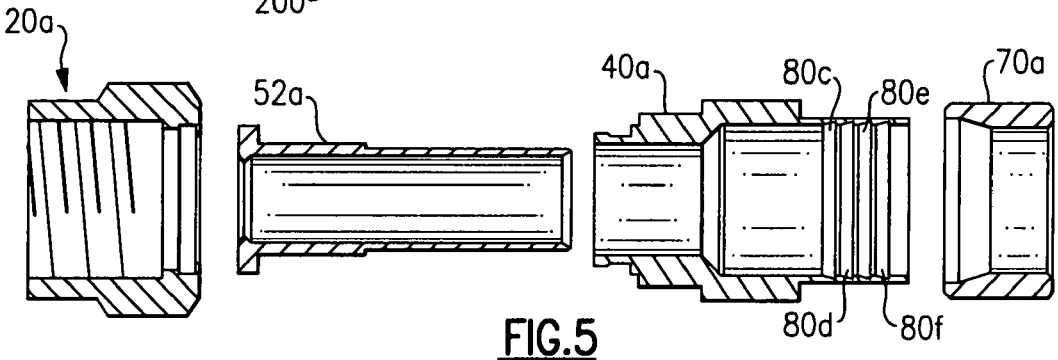
FIG. 5 is an front, exploded view, with partial cutaway of the connector of FIG. 4.

Referring now to FIGS. 4 and 5, an external radial compression type connector 10*a* and cable segment 100*a* are shown. This connector 10*a* also includes a fastening element 20*a*, a body portion 40*a*, a post 52*a*, and a locking member 70*a*, which can be in the form of a compression ring, each of which is generally similar in shape, design and purpose to the like numbered elements in FIGS. 1-3, except with regard to the surface features of the locking member 70*a*. As shown in FIGS. 4 and 5, the surface features of the locking member 70*a* can be in the form of annular serrations 800, 80D, 80E, 80F, each of which, however, has a similar function to and similar purpose as the protrusions 80A, 80B on the locking member 70 in the FIGS. 1-3 embodiment of the connector 10.

Figure 6:
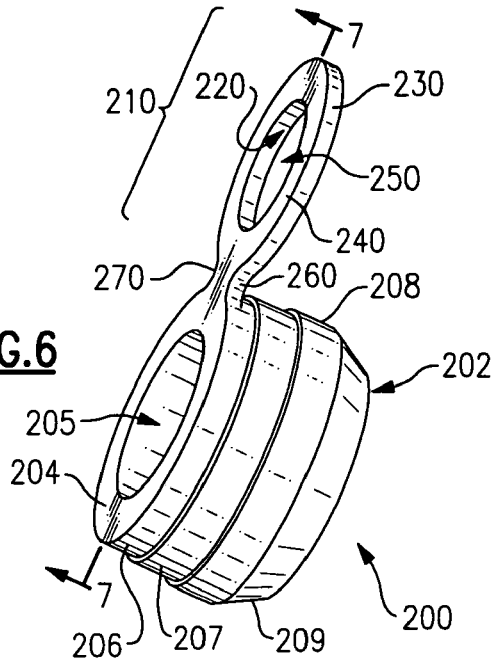
FIG. 6 is a front perspective view of the sealing element and adjoined attachment element of FIGS. 1, 2 and 4.
Figure 7:
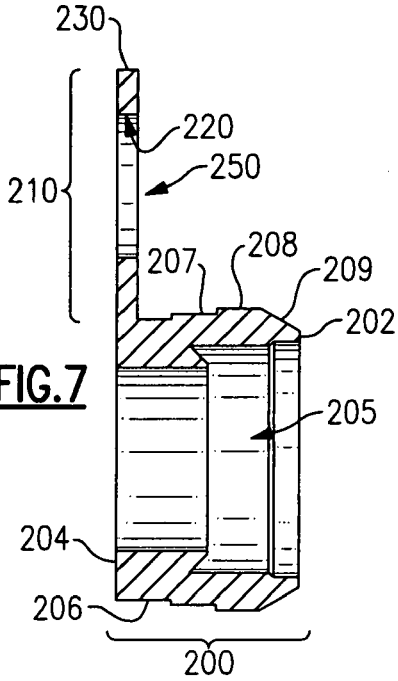
FIG. 7 is a side, cross-sectional view of the sealing element and adjoined attachment element taken along line 7-7 of FIG. 6.

Referring now to FIGS. 6 and 7, a seal element 200 for use with the connectors 10, 10*a* is shown. The seal element ("seal") 200 can be a moisture seal, an electrically conductive seal, or can serve both such purposes (i.e., can be simultaneously a moisture seal and an electrically conductive seal). The specific design and purpose of the seal 200 can vary due to one or more factors, including, but not limited to, the intended usage environment and/or usage purpose of the connectors 10, 10*a*.

The seal 200 has an open first end 202, an open second end 204 and a continuous bore 205 defined therebetween. The diameter of the bore 205 can be uniform or, as shown in FIG. 7, can be non-uniform, wherein, by way of non-limiting example, the diameter of the seal 200 decreases from its first end 202 to its second end 204. The seal 200 also can have a uniform outer diameter, or, as shown in FIGS. 6 and 7, a non-uniform outer diameter, which, by way of non-limiting example, increases from a first region 206, to a second region 207, to a third, region 208, and then decreases at a fourth region 209. It is understood, however, that the seal 200 can have other designs as are generally known in the art.

As shown in FIGS. 1, 2, 4 and 5, and prior to installation of a connector 10, 10*a*, the seal 200 can be attached to, adjoined to, or otherwise placed in tactile communication at any position along the connector through use of an attachment element 210. By way of non-limiting example, in FIGS. 1, 2, 4 and 5, the seal 200 is shown attached at various areas along the body portion 40, 40*a* of the connector 10, 10*a*.

As best depicted in FIG. 6, the attachment element 210 can be an annular element having an inner periphery 220, an outer periphery 230 and a main body 240 therebetween. The inner periphery 220 of the attachment element 210 has a generally cylindrical shape and surrounds an opening 250 defined within the attachment element 210. The outer periphery 230 of the attachment element 210 has a generally cylindrical shape as well, but also has first and second transition areas 260, 270, which, as best shown in FIG. 6, form the outer periphery of a connection area or zone 280 defined between the attachment element 210 and the seal 200.

It should be noted that the size and/or shape of one or both of the transition areas 260, 270 can differ from that/those which are shown in FIG. 6. By way of non-limiting example, one or both of the transition areas 260, 270 can be made thicker or thinner and/or longer or shorter. One or both of the transition areas 260, 270 can be made thinner so as to further simplify the process of separating the seal 200 from the attachment element 210 during installation of the connector 10, yet while still ensuring that the attachment element and seal remain reliably attached prior separation. Alternatively, one or both of the transition areas 260, 270 can be made thicker so as to provide added assurance that the attachment element 210 and seal 200 will remain reliably attached prior to being separated during installation of the connector 10, yet not so thick as to substantially inhibit such separation during installation. Generally, the specific size and shape of the transition area 260, 270 will depend on one or more of various factors, including but not limited to the installation setting and conditions for the connector 10, 10*a*.

It is currently preferred, but not required, for the attachment element 210 to be made of a polymeric material, such as an elastomeric material (e.g., a resin material such as an acetyl resin, of which one example is a Delrin® plastic) that can be stretched or elongated so as to reversibly increase the diameter of the opening 250 as desired. Thus, the attachment element 210 can be attached to, adjoined to, or otherwise placed into tactile communication with the connector 10 at various locations, including those having an effective diameter equal to or greater than the diameter of the opening 250. By way of non-limiting example, the diameter of the opening 250 can be less than or equal to the outer diameter of any, or, as is currently preferred, each of the locking member 70, 70*a*, body portion 40, 40*a*, or nut portion 20, 20*a* of the connector 10, 10*a*. Alternatively, the attachment element 210 can be made of a comparatively harder, non-elastomeric material, such as a non-elastomeric plastic or other material.

As shown in FIGS. 1, 2, 4 and 5, the attachment element 210, with attached seal 200, is placed at a predetermined placement location 300 on the connector 10, 10*a*. The attachment element 210 can be placed at this selected location 300 in either of at least two ways.

By way of a first placement example, and as illustrated in FIGS. 1 and 2, the opening 250 of the attachment element 210 is increased (e.g., by being stretched) to fit over the comparatively larger diameter end 26 and hex flats 32 of the nut portion 40. While the increased diameter of the opening 250 of the attachment element 210 is maintained, the attachment element is placed at its placement location 300, which can be, for example and as shown in FIG. 1, between the nut portion 20 and body portion 40 of the connector 10. Due to the ability to increase the diameter of the opening 250 of the attachment element 210, the placement location 300 can be any potion of the connector 10, 10*a*, including placement locations other than those shown in FIGS. 1 and 2 or in FIGS. 4 and 5.

By way of a second placement example, the opening 250 of the attachment element 210 is increased (e.g., by being stretched) to fit over the comparatively larger effective diameter end 72 of the compression ring 70, 70*a*. While the increased diameter of the opening 250 of the attachment element is maintained, the attachment element is fed over the compression ring 70, 70*a* and the main body 40, 40*a* and ultimately positioned at its predetermined placement location 300, e.g., between the nut portion 20, 20*a* and the body portion 40, 40*a* of the connector 10, 10*a*.

It is currently preferred, but not required, to attach the attachment element 210 to the connector 10, 10*a* at a placement location 300 that has an effective diameter less than the diameter of the unstretched opening 250 of the attachment element, as is the case with the placement locations 300 shown in FIGS. 1, 2, 4 and 5. Doing so allows the opening 250 to automatically revert to its unstretched diameter once it reaches the comparatively smaller diameter placement location 300. Moreover, once the attachment element has reverted to its unincreased diameter as such, the attachment element 210 will be assuredly retained at this placement location 300 because the unstretched diameter of the opening of the attachment element is less than the diameter of either the adjacent nut portion 20 or of body portion 40 of the connector 10. In other words, it would only be possible to remove the attachment element 210 from this placement location 300 by again increasing (e.g., restretching) the diameter of the opening 250 to be greater than that of either of the adjacent portions of the connector 10, 10*a*, or by cutting or otherwise breaking apart the main body 240 of the attachment element 210 between its outer periphery 230 and it inner periphery 220.

In short, the FIGS. 1, 2, 4 and 5 exemplary embodiments are highly advantageous in that once the attachment element 210 has been placed at the lesser diameter placement location 300 of the connector 10, 10*a*, unintentional separation of the seal 200 from the connector 10, 10*a* is effectively prevented, thus curbing, if not entirely solving, the problem of the seal 200 (which, as noted above, is attached to the attachment element 210) becoming inadvertently separated from the connector 10, 10*a* prior to installation on the connector.

Although the attachment element 210 is shown in FIGS. 1 and 2 as being attached at the desired lesser diameter placement location 300 between the nut portion 20 and the body portion 40 of the connector 10, it is understood that other placement locations on the connectors 10, 10*a* of FIGS. 1-5 are possible as well, including one or more other locations between the hex flats 32 of the nut portion and the first end 72 of the compression ring. Moreover, the attachment element 210 also can be attached to the connector 10, 10*a* at another location on the nut portion 20, 20*a*, if instead desired.

As noted above, the attachment element 210 serves a purpose of easily yet reliably maintaining the seal 200 in communication with the connector 10, 10*a* until such time as the connector is to be installed (e.g., until the connector is connected to an equipment port). When that is to occur, the seal 200 can be separated from the attachment element 210 by breaking the seal off or apart from the attachment element, e.g., at the connection area 280. Alternatively, a portion of the main body 240 of the attachment element 210 can be broken apart or cut open, thus detaching it, and, in turn, the seal 200, from the connector 10, 10*a*. Or instead, the diameter of the opening 250 of the attachment element 210 can be again increased (e.g., restretched) such that it can be fed over the nut 20, 20*a* of the connector 10, 10*a* or over the body portion 40, 40*a* and compression ring 70, 70*a* of the connector. In an embodiment in which the attachment element 210 is formed of a non-elastomeric material, it generally would be separated from the seal 200 by a snapping, twisting or cutting action, e.g., at the connection area 280.

Figure 8A:
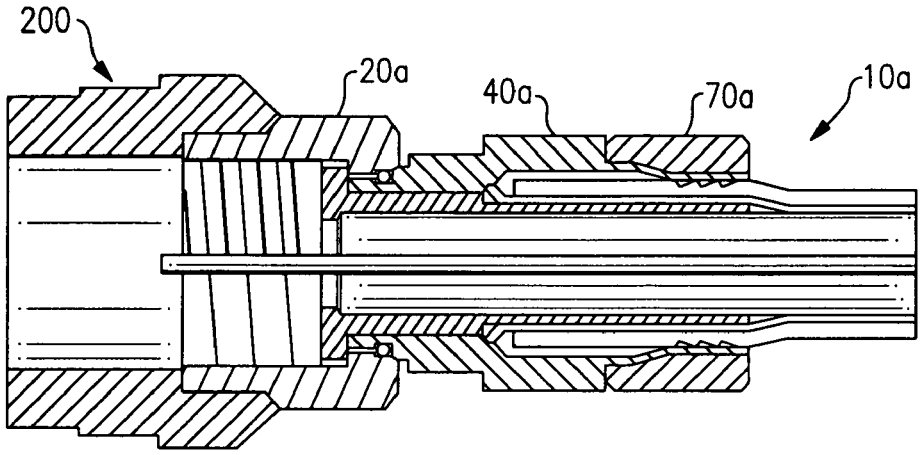
FIG. 8A is a side, cross-sectional view of the exemplary external compression connector of FIGS. 4 and 5 with the previously attached sealing element having been detached and connected to the connector.
Figure 8B:
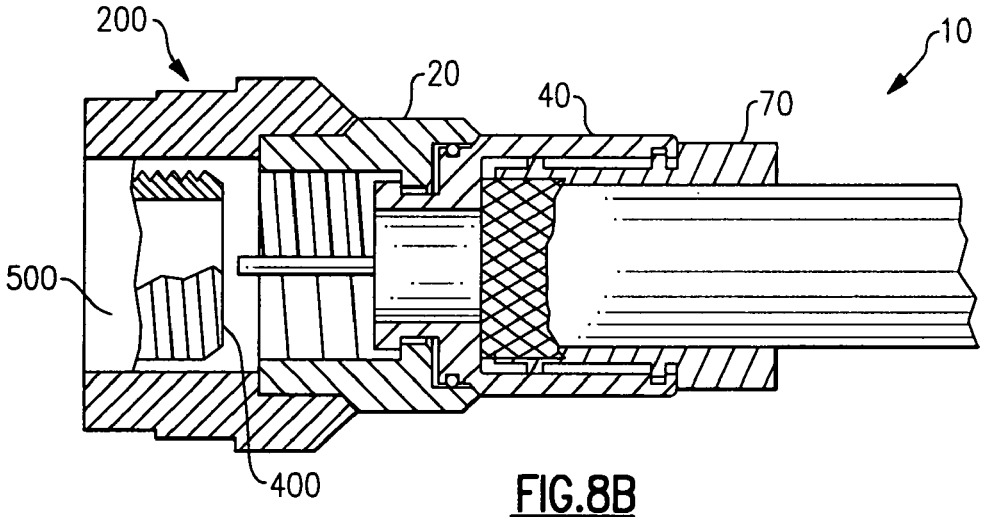
FIG. 8B is a side, cross-sectional view of the exemplary internal compression connector of FIGS. 2 and 3 with the previously attached sealing element having been detached and connected to connector, which also is shown having been connected to an equipment port.
Figure 9:
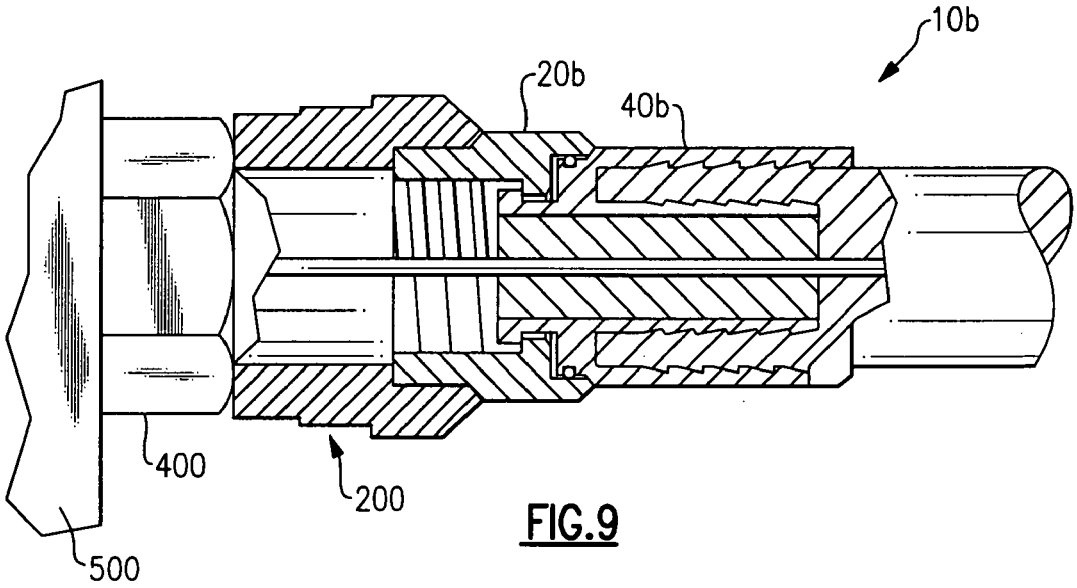
FIG. 9 is a side, cross-sectional view of an exemplary crimp-style connector with a previously attached sealing element having been detached and connected to the connector, which also is shown having been connected to an equipment port.

Once the seal 200 has been detached using one of these or other techniques, it then can be attached or otherwise connected to the connector 10, 10*a*, such as at the nut portion 20, 20*a*, or to an equipment port. FIG. 8A illustrates a connector 10*a* of the type shown in FIGS. 4 and 5 with the seal 200 having been connected to the nut portion 20*a* of the connector, whereas FIG. 8B depicts a connector 10 of the type shown in FIGS. 1-3 with the seal 200 having been connected to its nut portion 20. Also shown in FIG. 8B is a port 400 of a piece of equipment 500 to which the connector 10 can be connected. FIG. 9 depicts a crimp-type connector 10*b* (e.g., of the type shown and described in U.S. Pat. No. 4,990,106 to Szegda, which is incorporated by reference in its entirety herein) after a seal 200 has been connected thereto and following connection of the seal—and, thus, the attached connector—to the port 400 of a piece of equipment 500. The connection depicted in FIG. 9 generally would occur in the same manner for the connectors 10, 10*a* depicted in FIGS. 1-5, 8A and 8B and would be performed using equipment and techniques known in the art.

The attachment element 210 depicted and described herein has several advantages as compared to other attachment devices, such as the attachment ring of the "snap-n-seal"

connector of the '246 patent. For one, the attachment ring of the "snap-n-seal" connector of the '246 patent is not disclosed as being made of an elastomeric material; thus, its diameter cannot be reversibly modified. As such, the attachment ring of the '246 patent must be attached to its connector during assembly of the connector. In stark contrast, the elastomeric construction of the attachment element 210 described herein enables the attachment element to be attached not only at any location, but also at any time, including either during assembly of the connector 10 or thereafter.

Moreover, because the attachment ring of the "snap-n-seal" connector of the '246 patent is not made of an elastomer, it cannot be removed from the connector without being irreversibly broken. This presents a problem if, for example, the attachment ring is inadvertently broken prior to actual installation of the connector. In that case, the compression sleeve attached to the attachment ring of the "snap-n-seal" connector of the '246 patent cannot be reattached to the connector. That would render the compression sleeve susceptible to being lost or misplaced, thus defeating the main purpose of using the attachment ring of the "snap-n-seal" connector of the '246 patent. Here, one has the option of removing the attachment element 210 by again increasing (e.g., by restretching) the diameter of the opening 250 rather than by breaking the attachment element 210. That way, the detached attachment element 210 can again be reattached, if desired; by still again increasing (e.g., by restretching) the diameter of the opening 250 and once again taking the necessary steps to place the attachment element in the placement location 300 or in another suitable location.

Although various embodiments have been described herein with reference to various details, it is not intended that such details be regarded as limiting the scope of the embodiments, except as and to the extent that they are included in the following claims—that is, the foregoing description of such embodiments is merely illustrative, and it should be understood that variations and modifications can be effected without departing from the scope or spirit of the embodiments as set forth in the following claims. Moreover, any document(s) mentioned herein are incorporated by reference in their entirety, as are any other documents that are referenced within the document(s) mentioned herein.

We claim:

1. A compression connector for the end of a coaxial cable, the compression connector comprising:

a connector body having a first end, a second end, an outer diameter, and defining an internal cavity at the second end of the connector body;

a fastening element rotatably engaged with the first end of the connector body, said fastening element having an external surface and an internal surface, said internal surface configured to connect with a port on an electronic device;

an attachment element having an opening capable of being enlarged from a first, diameter less than at least a portion of the outer diameter of the connector body to a second, diameter greater than at least a portion of the outer diameter of the connector body, wherein the enlarged opening of the attachment element is capable of being placed around a portion of the connector body at a predetermined placement location; and a tubular moisture seal element attached to the attachment element, said tubular moisture seal being configured to extend over at least a portion of the external surface of the fastening element and extend over at least a portion of the port to form a seal therebetween;

a post disposed at least partially within the internal cavity at the second end of the connector body;

a locking member having a first end and a second end, wherein the second end of the locking member is disposed within the internal cavity at the second end of the connector body and the first end extends outwardly therefrom.

2. The compression connector of claim 1, wherein the fastening element is a nut.

3. The compression connector of claim 1, wherein the predetermined placement location has a diameter less than the first, unincreased diameter of the opening of the attachment element, whereby when the attachment element is placed into the predetermined placement location the diameter of the opening of the attachment element reverts toward the first, unincreased diameter.

4. The compression connector of claim 1, wherein the predetermined placement location is between the fastening element and the connector body.

5. The compression connector of claim 1, wherein the tubular moisture seal element is attached to the attachment element at a connection zone.

6. The compression connector of claim 1, wherein the attachment element is elastomeric.

7. A compression connector for the end of a coaxial cable, the compression connector comprising:

a connector body having a first end, a second end and an outer diameter, said connector body comprising:

a post disposed at least partially within the connector body;

a fastening element having a first end and a second end, wherein the second end of the fastening element is rotatably engaged with the first end of the connector body and the first end extends outwardly therefrom;

a locking member having a first end and a second end, wherein the second end of the locking member is at least partially disposed within the connector body;

an attachment element having an opening capable of being enlarged from a first, diameter less than at least a portion of the outer diameter of the connector body to a second, diameter greater than at least a portion of the outer diameter of the connector body, wherein the enlarged opening of the attachment element is capable of being placed around a portion of the connector body at a predetermined placement location; and a tubular moisture seal element attached to the attachment element, said tubular moisture seal being configured to engage the first end of the fastening element and extend over at least a portion of the port to form a seal therebetween.

8. The compression connector of claim 7, wherein the attachment element is elastomeric.

9. A method of preventing the inadvertent loss or misplacement of a port seal of a compression connector for the end of a coaxial cable, the method comprising the steps of:

providing a compression connector having an outer diameter and comprising:

a fastening element having a first end and a second end;

a connector body;

having a first end and a second end, the second end being rotatably engaged with the fastening element; and a post disposed at least partially within the main body portion; and a locking member having a first end and a second end, wherein the second end is disposed within the connector body and the first end extends outwardly thereof;

providing a tubular port seal element that is attached to an attachment element, the attachment element having an opening, wherein the opening has a first, unincreased diameter less than at least a portion of the outer diameter of the connector body;

increasing the unincreased diameter of the opening of the attachment element to become a second, increased diameter, wherein the second, increased diameter is greater than at least a portion of the outer diameter of the connector body; and while the second, increased diameter of the attachment element is substantially maintained, placing the opening of the attachment element around a predetermined placement location between the fastening element and the connector body.

10. The method of claim 9, wherein the attachment element is elastomeric.

* * * * *